US011099505B2

(12) United States Patent
Hirayama

(10) Patent No.: US 11,099,505 B2
(45) Date of Patent: Aug. 24, 2021

(54) ROTATION MEMBER SUPPORT CONFIGURATION AND FIXING DEVICE USING SAME

(71) Applicant: CANON KABUSHIKI KAISHA, Tokyo (JP)

(72) Inventor: Taiya Hirayama, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/899,409

(22) Filed: Jun. 11, 2020

(65) Prior Publication Data

US 2020/0393783 A1 Dec. 17, 2020

(30) Foreign Application Priority Data

Jun. 14, 2019 (JP) ..... JP2019-111593

(51) Int. Cl.
*G03G 15/20* (2006.01)

(52) U.S. Cl.
CPC ..... *G03G 15/2025* (2013.01); *G03G 15/2064* (2013.01)

(58) Field of Classification Search
CPC ..... G03G 15/2025; G03G 21/1685; F16F 2230/007; F16F 2230/0082; F16F 1/128; F16F 2228/10; F16C 19/26
See application file for complete search history.

(56) References Cited

U.S. PATENT DOCUMENTS 4,850,584 A * 7/1989 Watashi ..... B65H 27/00 271/274
5,044,624 A * 9/1991 Haus ..... B41F 13/20 271/274
5,600,426 A * 2/1997 Gramlich ..... B65H 5/062 271/274
6,857,631 B2 * 2/2005 Morrison ..... B65H 5/06 267/155
7,429,042 B2 * 9/2008 Ban ..... B65H 5/062 271/272
7,632,019 B2 * 12/2009 Gilbertson ..... G03G 15/6529 384/276
9,156,639 B1 * 10/2015 Inoue ..... B65H 5/062

FOREIGN PATENT DOCUMENTS

JP 3614517 B2 * 1/2005 ..... G03G 15/00
JP 2006-44938 A 2/2006
JP 2015-178402 A 10/2015

* cited by examiner

*Primary Examiner* — Arlene Heredia
(74) *Attorney, Agent, or Firm* — Canon U.S.A., Inc. I.P. Division

(57) ABSTRACT

A rotation member support configuration supports a roller and applies pressure in a direction orthogonal to the rotational axis line of the roller, using a spring attached around a bearing. The spring includes two coils differing from each other in twisting direction and connected at an angle formed with respect to a coil axis line direction.

10 Claims, 11 Drawing Sheets

ROTATION MEMBER SUPPORT CONFIGURATION AND FIXING DEVICE USING SAME

BACKGROUND

Field of the Disclosure

The present disclosure relates to a rotation member support configuration to be used in an apparatus such as a printer that forms an image on a recording medium, and the rotation member support configuration adds an urging force in a direction orthogonal to the rotational axis line of a rotation member, while supporting the rotation member to be rotatable.

Description of the Related Art

In an image forming apparatus such as a printer and copier, various rotation members including a sheet conveyance roller, a fixing roller, and a cleaning roller are each rotatably supported by an urging force added in a direction orthogonal to the rotational axis line of the rotation member. Japanese Patent Application Laid-Open No. 2015-178402 discusses a rotation member support configuration in which the rotation shaft of one of a pair of rollers for nipping and supporting a sheet is rotatably supported by a bearing, and the other roller of the pair is biased by a pulling spring arranged around the outer periphery of the bearing. A nip pressure is thereby exerted on a contact portion of the pair of rollers, so that a sheet can be conveyed. Such a rotation member support configuration is space-saving and low-cost, so that the configuration is adopted in many products.

In a pressure configuration having a pulling spring around the outer periphery of a bearing, there is used a configuration in which a hook having a shape protruding outward from the outer periphery of a coil of the pulling spring is formed at each of both ends of the coil. In this configuration, a spring hook portion is formed at an end surface of a sheet metal frame that supports the bearing, and the hook of the spring can be hooked onto the spring hook portion, thereby allowing for implementation with low cost and reduced space.

The coil is brought into contact with the outer periphery of the bearing and thereby deformed in a curved shape, and the curved coil of the spring attached around the bearing has a force for returning to a straight line, so that a force in a twisting direction is exerted at a root portion of the hook, which may lower the durability of the spring.

SUMMARY

The present disclosure is directed to a rotation member support configuration for improving durability of an urging member that urges a rotation member in a direction orthogonal to a rotational axis line of the rotation member while rotatably supporting the rotation member, and is also directed to a fixing device using the rotation member support configuration.

According to an aspect of the present disclosure, a rotation member support configuration rotatably supports a rotation member, and the rotation member support configuration includes a rotation member configured to rotate, a bearing portion configured to rotatably support the rotation member, a pressed member configured to be pressed by the rotation member, a spring member configured to press the rotation member toward the pressed member and including hook portions on both ends thereof, a first coil portion formed by spirally winding an element wire, a second coil portion formed by spirally winding an element wire, and a connection portion formed of a linear element wire and connecting the first coil portion and the second coil portion, and a support member configured to support the bearing portion and the pressed member. The spring member is attached by hooking each of the hook portions, provided on the both ends on the support member, such that the connection portion presses the bearing portion.

Further features of the present disclosure will become apparent from the following description of exemplary embodiments with reference to the attached drawings.

DESCRIPTION OF THE EMBODIMENTS

An image forming apparatus according to an exemplary embodiment of the present disclosure will be described below in detail with reference to the drawings. In the present exemplary embodiment, a roller support configuration of a cleaning unit included in a fixing device of an electrophotographic printer will be described as an example, but application targets of the present disclosure is not limited thereto.

[Image Forming Apparatus]

Figure 1:
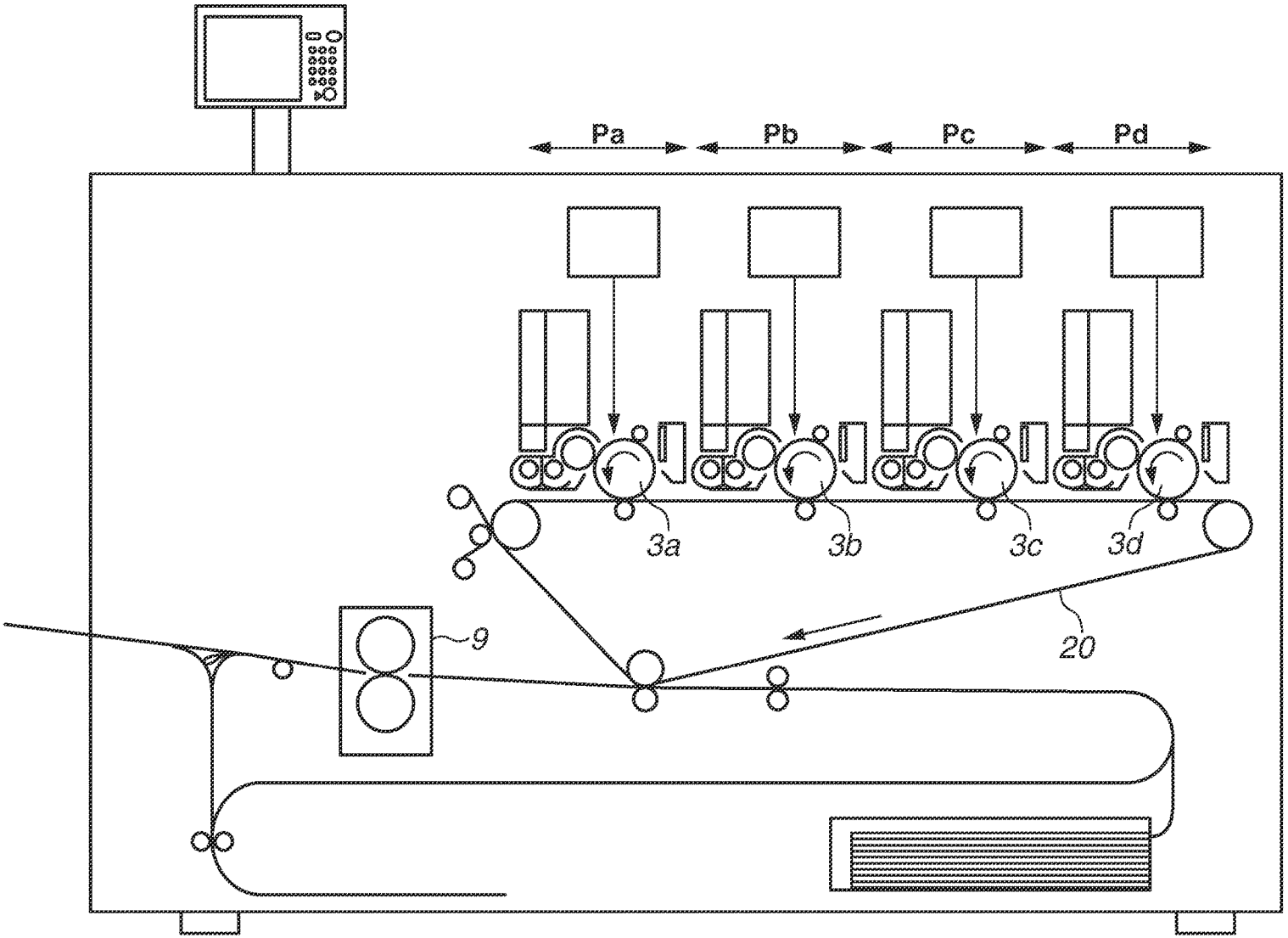
FIG. 1 is a cross-sectional diagram illustrating an image forming apparatus according to an exemplary embodiment of the present disclosure.

FIG. 1 is a configuration schematic diagram illustrating an image forming apparatus according to the present exemplary embodiment.

In the image forming apparatus illustrated in FIG. 1, first, second, third, and fourth image forming units, i.e., image forming units Pa, Pb, Pc, and Pd, are disposed side by side. The image forming units Pa, Pb, Pc, and Pd form toner images of the respectively different colors through a latent-image forming process, a development process, and a transfer process, and each of the image forming units operates as follows based on an instruction from a central processing unit (CPU) to start image formation.

The image forming units Pa, Pb, Pc, and Pd include respective dedicated image carriers, i.e., in this example, electrophotographic photosensitive drums 3*a*, 3*b*, 3*c*, and 3*d*. The toner images of the respective colors are formed on the respective photosensitive drums 3*a*, 3*b*, 3*c*, and 3*d*. An intermediate transfer member 20 is disposed next to the photosensitive drums 3*a*, 3*b*, 3*c*, and 3*d*, and the toner images of the respective colors formed on the photosensitive drums 3*a*, 3*b*, 3*c*, and 3*d* are primarily transferred onto the intermediate transfer member 20, and then transferred onto a recording medium P at a secondary transfer portion. The recording medium P onto which the toner images have been transferred is conveyed to a fixing device 9 that fixes the toner images by applying heat and pressure. Subsequently, the recording medium P is discharged to the outside of the image forming apparatus as a recorded image.

<Fixing Device>

Figure 2:
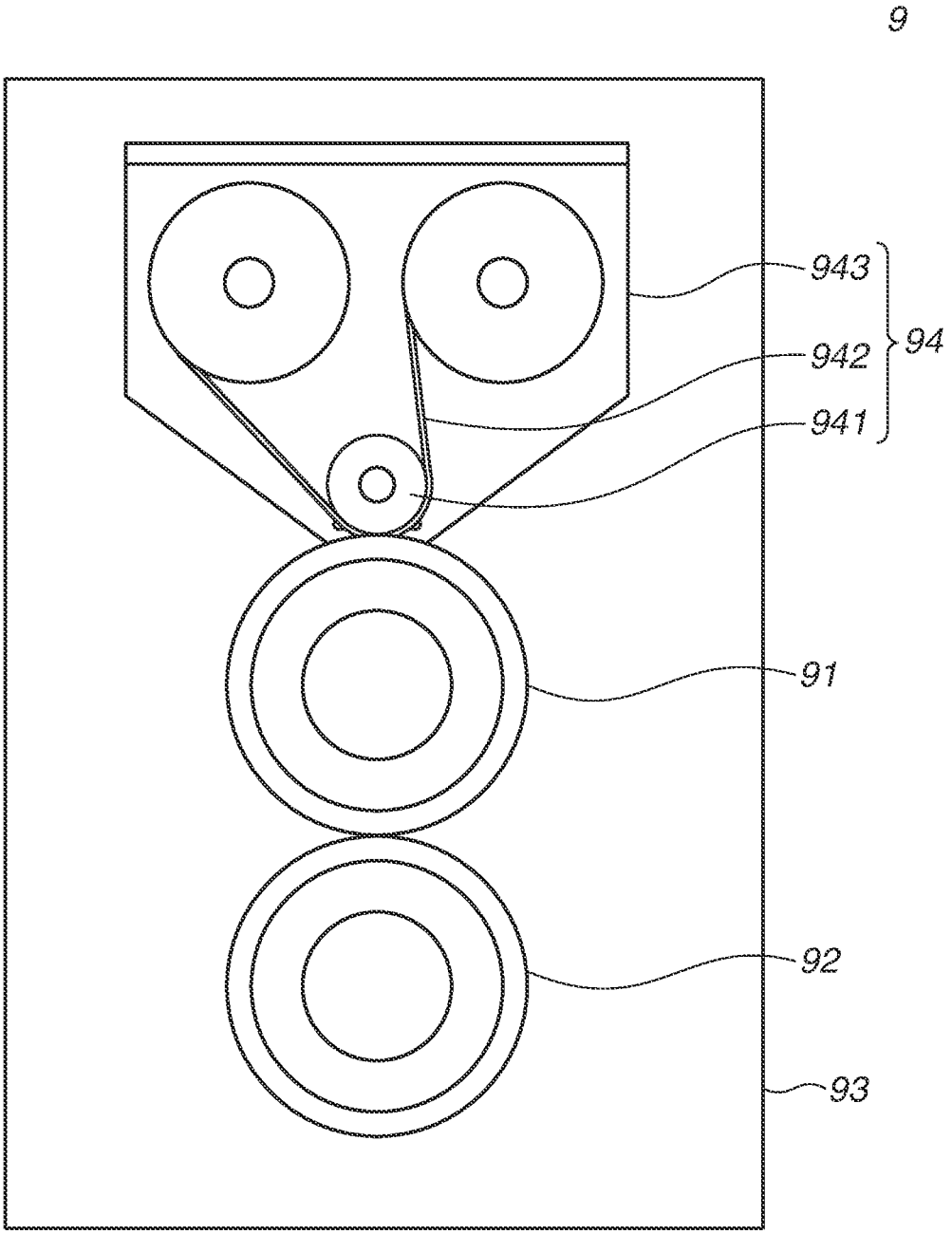
FIG. 2 is a cross-sectional diagram illustrating a fixing device according to the exemplary embodiment of the present disclosure.
Figure 3:
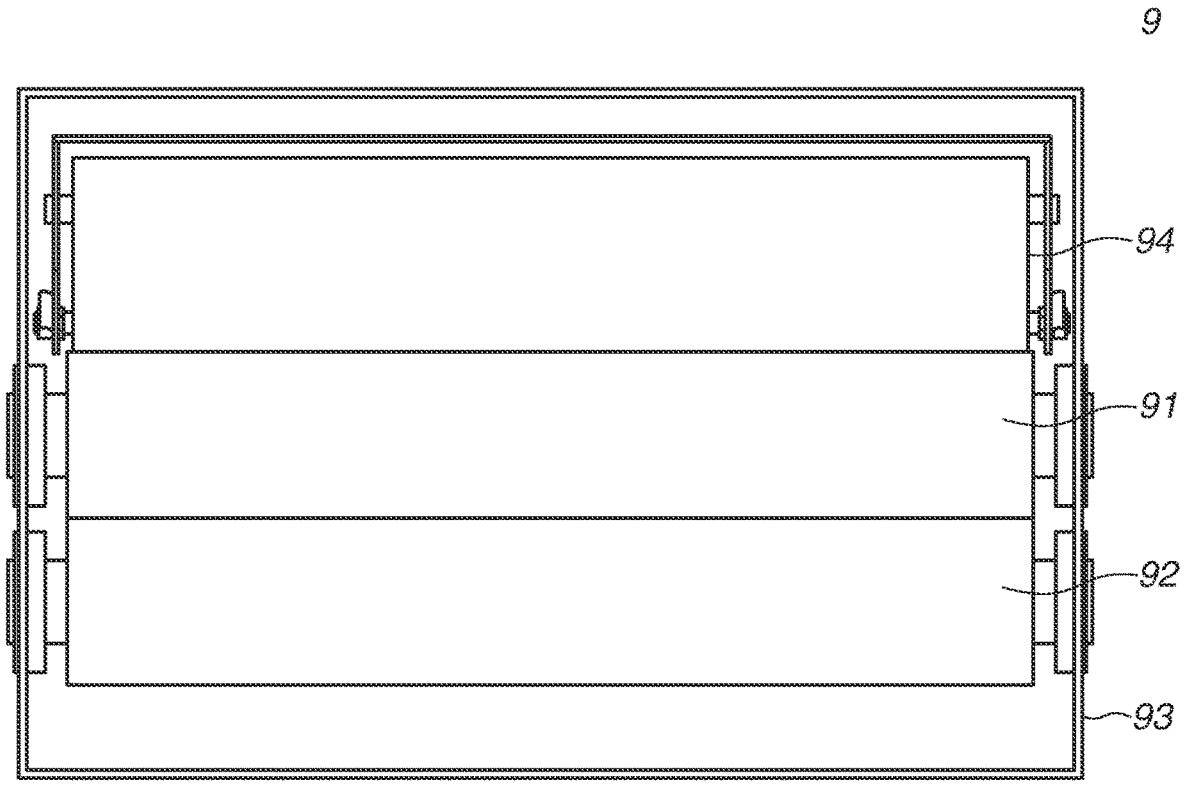
FIG. 3 is a side view of the fixing device according to the exemplary embodiment of the present disclosure.

FIG. 2 illustrates a front sectional view of the fixing device 9 in the present exemplary embodiment, and FIG. 3 illustrates a side view of the fixing device 9 in the present exemplary embodiment.

The fixing device 9 includes a fixing roller 91 as a fixing member, and a pressure roller 92 as a pressure member. Inside the fixing roller 91, a heater (not illustrated) is disposed as a heating unit and configured to heat the fixing roller 91 to a predetermined temperature. At a fixing nip formed by the fixing roller 91 and the pressure roller 92, the recording medium P carrying an unfixed toner image is nipped and conveyed, and the toner image is fixed to the recording medium P by application of heat and pressure.

<Cleaning Device>

A cleaning unit 94 for removing offset toner adhering to the fixing roller 91 is disposed near the fixing roller 91. The cleaning unit 94 is attached to be movable between a cleaning position where the cleaning unit 94 abuts the fixing roller 91 and a standby position where the cleaning unit 94 is separated from the fixing roller 91.

Figure 4:
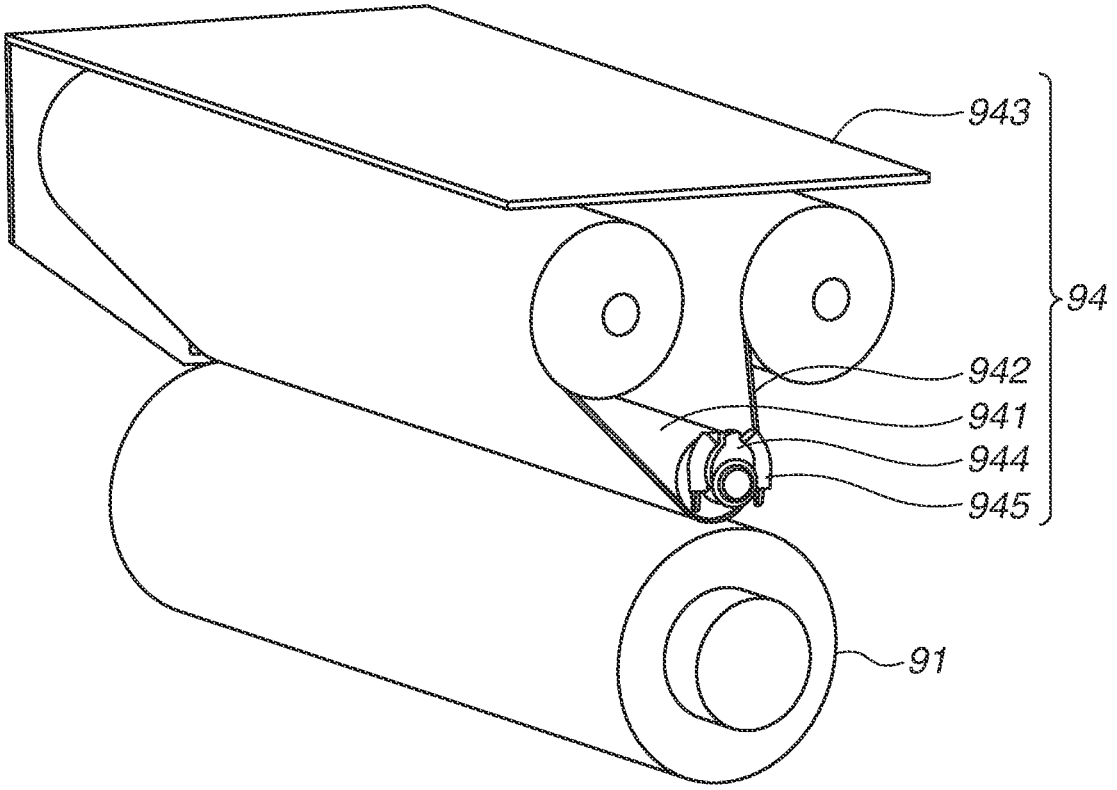
FIG. 4 is a perspective diagram illustrating a cleaning device according to the exemplary embodiment of the present disclosure.

FIG. 4 illustrates the cleaning unit 94, and the fixing roller 91 to be cleaned. For descriptive purposes, a part of a frame 943 of the cleaning unit 94 is not illustrated. In the cleaning unit 94, a cleaning roller 941 is rotatably supported, and a cleaning web 942 is wrapped around the cleaning roller 941. A beating 944 is disposed at each end of the frame 943 in an image width direction, and supports the cleaning roller 941 to be rotatable. A pulling spring 945 is placed around the outer periphery of the bearing 944, and urges the cleaning roller 941 in a direction toward the fixing roller 91. When the cleaning unit 94 is at the cleaning position, the cleaning roller 941 abuts the fixing roller 91, so that the pulling spring 945 disposed around the outer periphery of the bearing 944 extends to urge the cleaning roller 941 toward the fixing roller 91. Then, a nipping force to he used for cleaning of the offset toner is generated.

The width of each of the cleaning roller 941 and the cleaning web 942 is set to be larger than a maximum width of an image that can be formed by the image forming apparatus. The offset toner adhering to the surface of the fixing roller 91 is collected by the cleaning web 942 at a cleaning nip portion formed by the fixing roller 91 and the cleaning roller 941 when the fixing roller 91 rotates.

<Support for Cleaning Roller and Pressure Configuration>

A rotation member support configuration will be described in detail.

The frame 943 (a support member) of the cleaning unit 94 that is an example of the rotation member support configuration has such a configuration that a side plate of a sheet metal is disposed at each end thereof in the image width direction.

Figure 5:
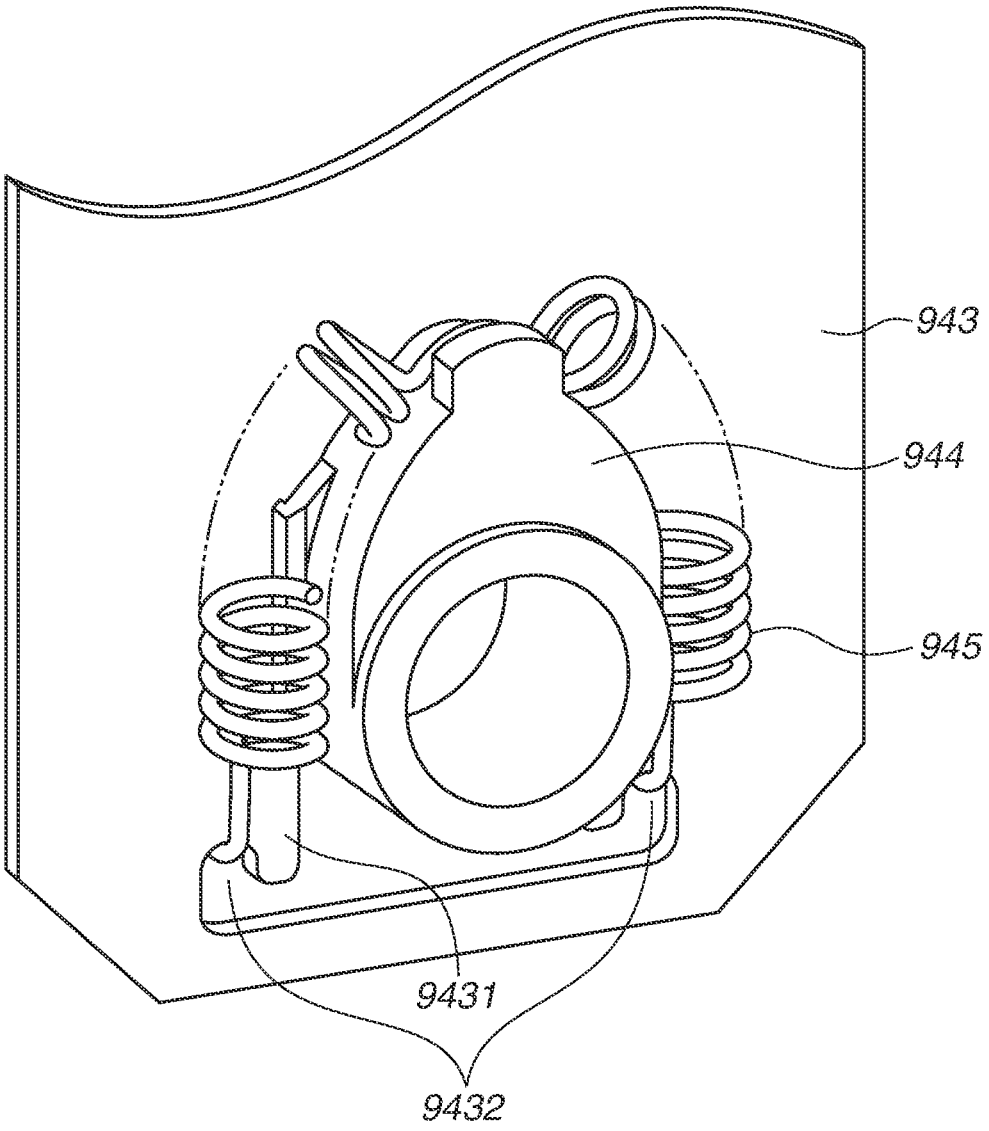
FIG. 5 is a perspective diagram illustrating a rotation member support configuration according to the exemplary embodiment of the present disclosure.
Figure 6:
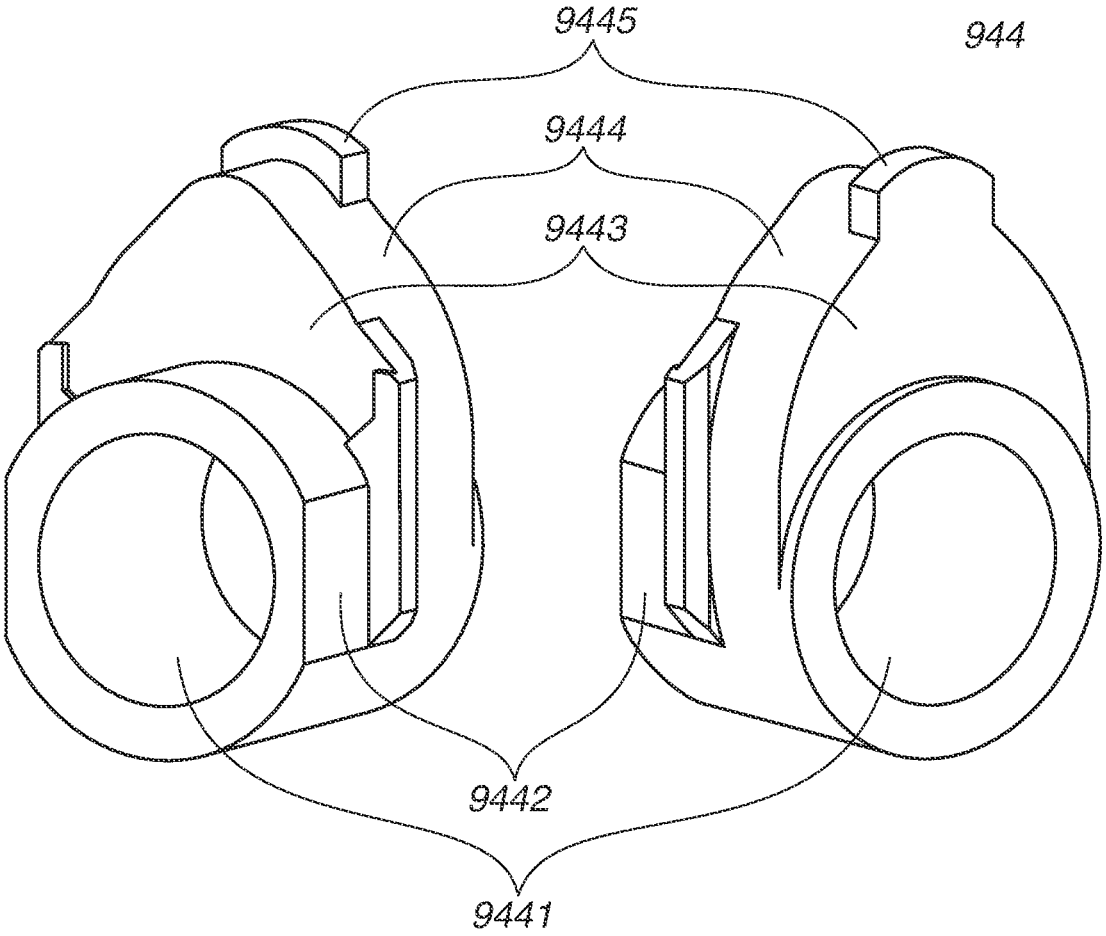
FIG. 6 is a perspective diagram illustrating a bearing to be used in the rotation member support configuration according to the exemplary embodiment of the present disclosure.
Figure 7:
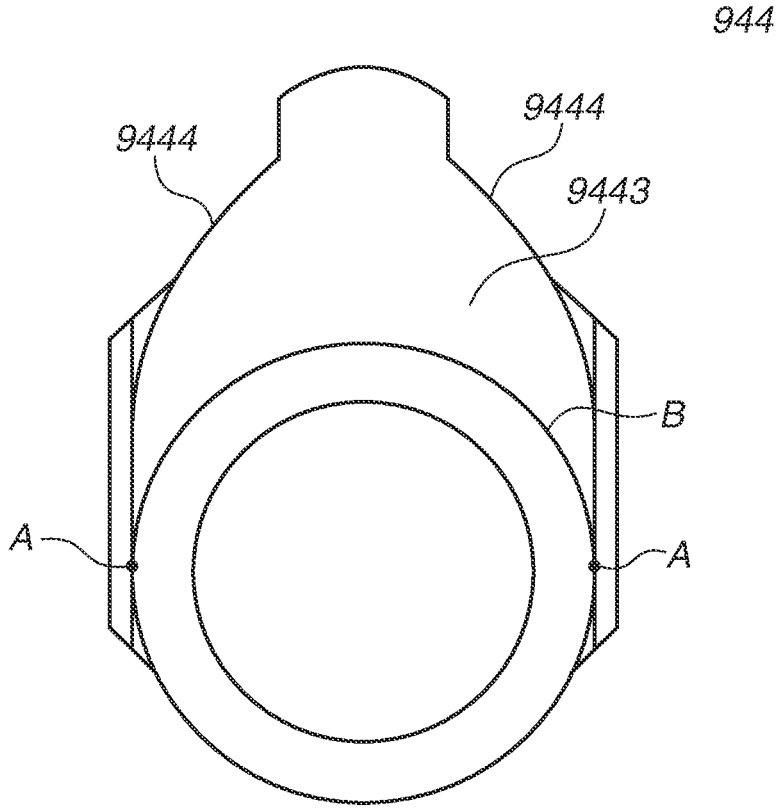
FIG. 7 is a front view of the bearing to be used in the rotation member support configuration according to the exemplary embodiment of the present disclosure.
Figure 8:
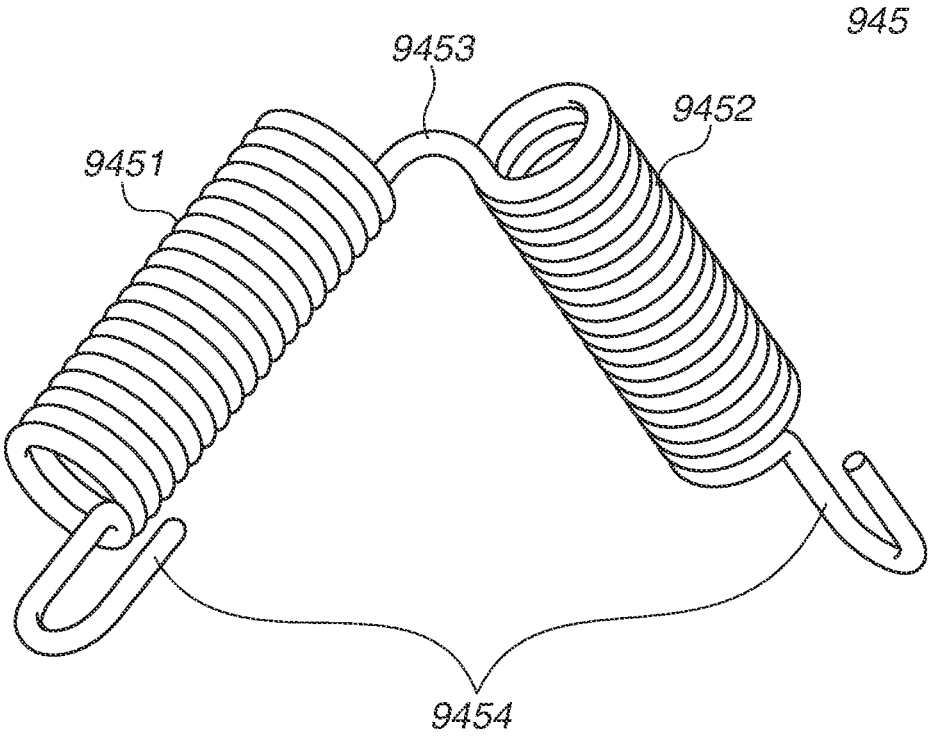
FIG. 8 is a perspective diagram illustrating a spring to be used in the rotation member support configuration according to the exemplary embodiment of the present disclosure.

FIG. 5 illustrates details of a bearing portion that supports the cleaning roller 941 that is a rotation member that rotates. FIG. 6 and FIG. 7 are diagrams that illustrate the bearing 944, and. FIG. 8 is a diagram that illustrates the pulling spring 945 (a spring member) disposed around the outer periphery of the bearing 944. The cleaning roller 941 is configured to press the fixing roller 91, i.e., a pressed member, via the cleaning web 942.

The bearing 944 (the bearing portion) that supports the cleaning roller 941 rotating can be slidably supported by a guide portion 9431 located at the side plate. Formed at each of both ends of the pulling spring 945 placed around the outer periphery of the bearing 944 is a hook 9454 (a hook portion) having a shape protruding from the outer periphery of each of a first coil 9451 (a coil portion) and a second coil 9452 (a coil portion) of the pulling spring 945. The hook 9454 is secured to a spring hook portion 9432 formed on an end surface of the side plate.

The bearing 944 includes a hole 9441 for supporting rotation of the cleaning roller 941, and a guide portion 9442 to be engaged with the guide portion 9431 of the side plate of the cleaning unit 94. A spring support portion 9443 has a shape protruding in a direction opposite to the pressing direction of the cleaning roller 941 from a concentric circle B of the inner diameter of the hole 9441 and passing through each point A where the pulling spring 945 abuts the bearing 944 at a position closest to the hole 9441. In other words, the spring support portion 9443 is a convex-shaped portion. The pulling spring 945 is placed around the spring support portion 9443. A spring coil contact surface 9444 of the spring support portion 9443 is formed with a curvature radius larger than that of the above-described concentric circle B. Disposed at a position the bearing 944 is to be engaged with a connection portion 9453 of the pulling spring 945 is a rib 9445 (a wall portion) that prevents the connection portion 9453 from falling off the end portion of the cleaning roller 941.

The pulling spring 945 has a configuration in which the connection portion 9453 connects the first coil 9451 (the coil portion) and the second coil 9452 (the coil portion) that vary in winding direction. Disposed at an end portion of each coil portion opposite to the connection portion 9453 is the hook 9454 that protrudes outward from the outer periphery of the coil facing the hook 9454. The shapes of these are formed from a single rod in a continuous manner. In the present exemplary embodiment, the material of the pulling spring 945 is stainless steel. The thickness of the wire is 0.8 mm. The outside diameter of each of the first coil 9451 and the second coil 9452 is 4 mm. The free length of each of the first coil 9451 and the second coil 9452 is 10 mm, and the length of the connection portion 9453 is 6 mm. The life of a coil tends to be short if the free length of the coil is short. Therefore, in the present exemplary embodiment, the length of the connection portion 9453 is as short as possible to increase the free length of each of the first coil 9451 and the second coil 9452. For this reason, the free length of each of the first coil 9451 and the second coil 9452 is longer than the length of the connection portion 9453. The above-described size of the pulling spring 945 is a mere example and the size thereof is not limited thereto.

The connection portion 9453 has a shape that is bent and raised in a direction of a coil axial line from the winding end of each of the first coil 9451 and the second coil 9452. Because the connection portion 9453 is provided with such a bent portion, an angle is formed in the direction of the axis line of each of the first coil 9451 and the second coil 9452. As illustrated in FIG. 5, the pulling spring 945 is attached so that the connection portion 9453 is supported at the top of the spring support portion 9443 of the bearing 944. If an angle formed by the directions of the axis lines of the first coil 9451 and the second coil 9452 is made small and the protrusion amount of the spring support portion 9443 of the bearing 944 is made large, the coil length when the pulling spring 945 is placed around the bearing 944 can be made long, which allows for a spring design with a small spring constant. In a case where the pulling springs 945 are designed to have an equal spring force for urging the cleaning roller 941, the variation in spring force due to the variation in component dimension can be reduced by a smaller spring constant. In addition, the amplitude of a stress variation that occurs in the pulling spring 945 due to attachment/detachment operation of the cleaning unit 94 can be made small, and thus the durability of the pulling spring 945 can be increased.

Although the angle formed by the axial lines (free length directions) of the first coil 9451 and the second coil 9452 varies depending on a space available for implementation of the pulling spring 945 and a desirable swing force, this angle is desirably 120 degrees or less so that the sum of the lengths of these two coils is longer than the coil length of a conventional swing.

Meanwhile, if the angle formed by the axial lines of the first coil 9451 and the second coil 9452 is acute, the following issue arises. When the pulling spring 945 is manufactured using a forming machine, the first-formed coil interferes with the machine when the second coil is formed. To avoid this issue, the angle formed by the axial lines of the first coil 9451 and the second coil 9452 is desirably 80 degrees or more. If this angle is smaller than 80 degrees, it may be necessary to perform a process for bending the connection portion 9453 besides the process using the forming machine. This leads to an increase in cost.

In other words, the angle formed by the axial lines of the first coil 9451 and the second coil 9452 is desirably 80 degrees or more and 120 degrees or less. In the present exemplary embodiment, the angle formed by the axial lines of the first coil 9451 and the second coil 9452 is 90 degrees.

Figure 9:
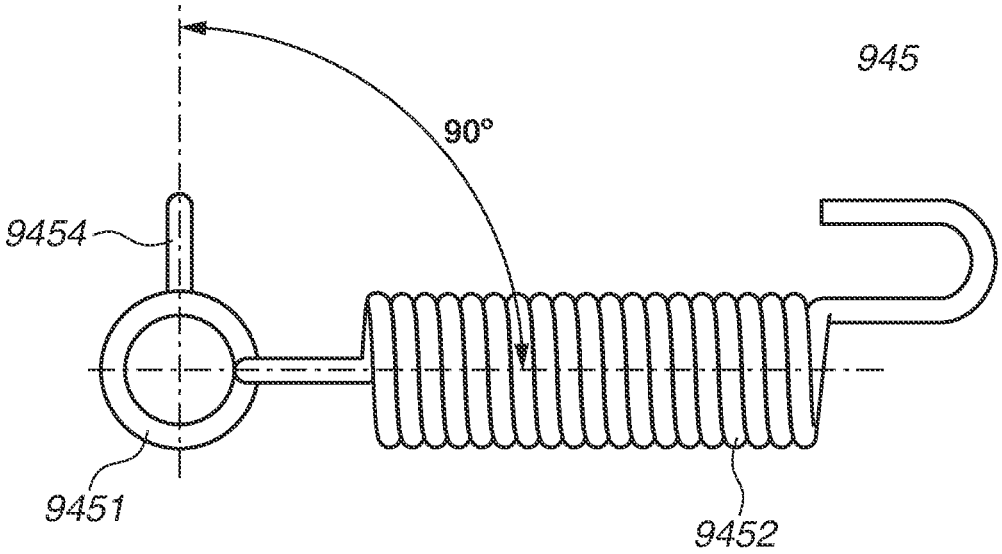
FIG. 9 is a side view of the spring to be used in the rotation member support configuration according to the exemplary embodiment of the present disclosure.

The hook 9454 at the end portion of each of the first coil 9451 and the second coil 9452 needs to protrude toward the side plate when the pulling spring 945 is placed around the bearing 944. In consideration of workability for securing the hook 9454 to the spring hook portion 9432 of the side plate, an angle formed by the hook 9454 at one of the end portions of the first coil 9451 and the second coil 9452 and the other coil when viewed from the direction of the axis line of the other coil is desirably 90±45 degrees, i.e., in a range of 45 degrees or more and 135 degrees or less. In the present exemplary embodiment, when viewed from the direction of the axis line of the first coil 9451, the angle formed by the hook 9454 of the first coil 9451 and the second coil 9452 is 90 degrees, as illustrated in FIG. 9.

Figure 10:
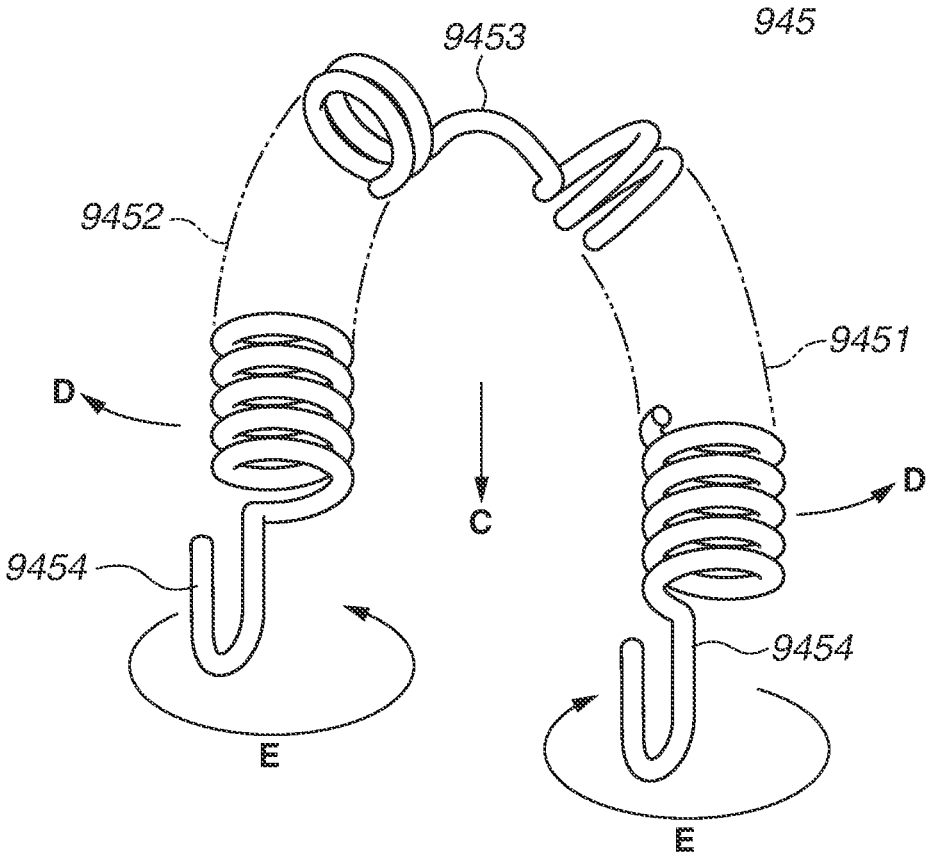
FIG. 10 is a diagram illustrating an active state of the spring to be used in the rotation member support configuration according to the exemplary embodiment of the present disclosure.

FIG. 10 illustrates a state where the pulling spring 945 is placed around the bearing 944. The first coil 9451 and the second coil 9452 of the pulling spring 945 are connected by the connection portion 9453 at an angle of 90 degrees therebetween, and the hooks 9454 at the other ends opposite of the connection portion side are attached so that the directions of the coil axis lines are parallel to a pressing direction C of the cleaning roller 941. For this reason, a curvature is formed in each of the coils, and a force D for returning the coil to a straight line is generated. The coil tends to return to the straight line in a state where the hook 9454 protruding outward from the outer periphery of the coil is secured to the spring hook portion 9432 of the side plate, and thus a twisting force E occurs at a root portion of the hook 9454 at each end of the pulling spring 945.

Figure 11:
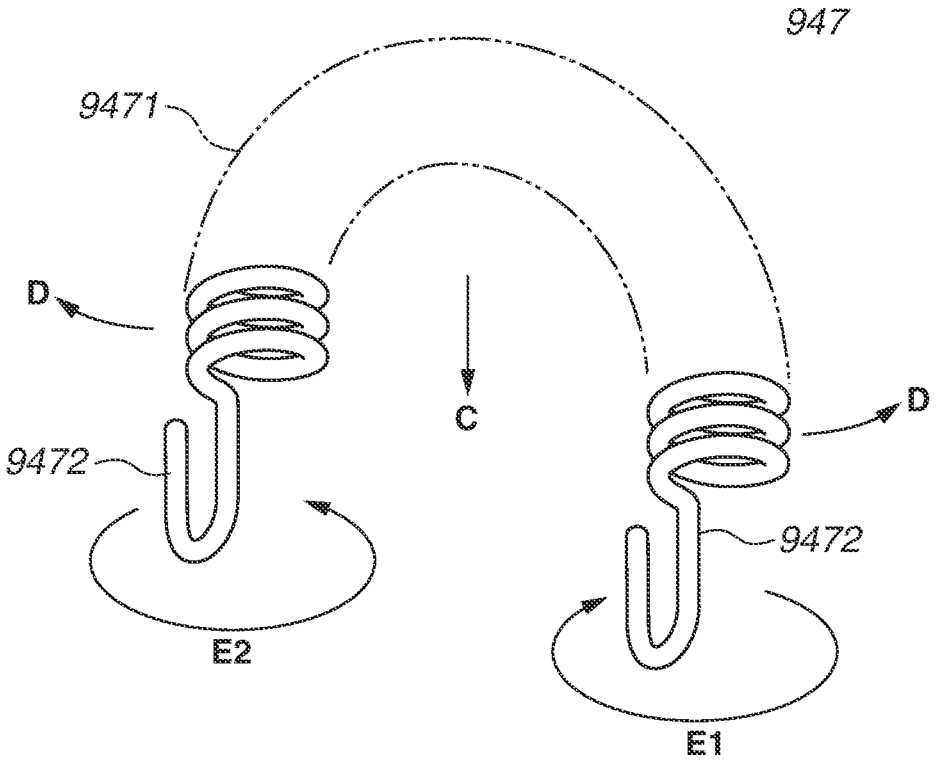
FIG. 11 is a diagram illustrating an active state of a spring to be used in a conventional rotation member support configuration.

Here, a force that acts on a spring in a conventional rotation member support configuration will be described with reference to FIG. 11, for comparison.

In a conventional spring 947, a hook 9472 is formed at each end of one coil 9471, and the hook 9472 has a shape protruding outward from the outer periphery of the coil 9471. FIG. 11 illustrates a state where the conventional spring 947 is placed around the outer periphery of a cylindrical bearing. The coil 9471 curved at 180 degrees is placed around the bearing, and a force D for returning the coil 9471 to a straight line occurs at each of the coil 9471. The coil 9471 tends to return to the straight line in a state where the hook 9472 protruding outward from the outer periphery of the coil 9471 is secured to a spring hook portion of a side plate, and thus twisting forces E1 and E2 occur at root portions of the hooks 9472 located at both ends of the conventional spring 947. The directions of these twisting forces at the both ends of the conventional spring 947 differ from each other. The twisting force E1 acts in a direction for loosening the winding of the coil 9471, and the twisting force E2 acts in a direction for tightening the winding of the coil 9471.

When the twisting force acting in a coil circumferential direction is applied to the root of the hook 9472 in addition to a pulling force of the conventional spring 947 that is a pulling spring, a greater stress occurs near the root of the hook 9472 than in a case where only the pulling force acts. In particular, a greater stress occurs in the hook 9472 on the twisting force E2 acts in the direction for tightening the winding of the coil 9471 than in the hook 9472 on which the twisting force E1 acts in the direction for loosening the winding of the coil 9471. The durability of the spring 947 is affected by the durability of the root portion of the hook 9472 on which the twisting force E2 acts in the direction for tightening the winding of the coil 9471, so that the durability of the spring 947 can be reduced.

The force that acts on the pulling spring 945 of the present exemplary embodiment will be confirmed with reference to FIG. 10, again.

In the pulling spring 945 according to the present exemplary embodiment, the first coil 9451 and the second coil 9452 are each curved at 45 degrees, i.e., the curvature of 90 degrees in total is formed. Therefore, the force D for returning the pulling spring 945 to the straight line and the twisting force E that occurs at the root portion of the hook 9454 are smaller than those of the conventional spring 947. Further, in the pulling spring 945 according to the present exemplary embodiment, the winding directions of the first coil 9451 and the second coil 9452 are opposite from each other. Specifically, the first coil 9451 is wound clockwise, and the second coil 9452 is wound counterclockwise. In both of these coils, the twisting force E that occurs at the hook root portion acts in the direction for loosening the winding of the coil. A stress that occurs at the hook root portion due to the twisting force in this direction is small, as compared with that in the direction for tightening the winding of the coil.

As described above, the rotation member support configuration according to the present exemplary embodiment can improve the spring durability for the following reasons, compared to the conventional rotation member support configuration.

The spring has the configuration in which the two coils are connected, so that the spring constant is reduced, and the amplitude of the stress that occurs in the spring is made small.

The curvature of the coil of the spring placed round the bearing is made small, so that the twisting force exerted near the hook is reduced.

The two coils wound in different winding directions are used, and the twisting force exerted near the hook acts in the direction for loosening the coil, so that the stress that occurs due to the twisting force is reduced.

In the above-described exemplary embodiment, description is given using a configuration in which the cleaning roller that is the rotation member presses the fixing roller that is the pressed member. The present disclosure is not limited to this exemplary embodiment. For example, the present disclosure is also applicable to, other than the cleaning roller, a metal roller that presses the pressure roller of the fixing device. The present disclosure is also applicable to, other than the fixing device, a conveyance roller that presses another roller.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-111593, filed Jun. 14, 2019, which is hereby incorporated by reference herein in its entirety.

What is clamed is:

1. A rotation member support configuration that rotatably supports a rotation member, the rotation member support configuration comprising:

a rotation member configured to rotate;

a bearing portion configured to rotatably support the rotation member;

a pressed member configured to be pressed by the rotation member;

a spring member configured to press the rotation member toward the pressed member, the spring member including hook portions on both ends thereof, a first coil portion formed by spirally winding an element wire, a second coil portion formed by spirally winding an element wire, and a connection portion formed of a linear element wire and connecting the first coil portion and the second coil portion; and a support member configured to support the bearing portion, wherein the spring member is attached by hooking each of the hook portions on the support member such that the connection portion presses the bearing portion.

2. The rotation member support configuration according to claim 1, wherein the first coil portion and the second coil portion differ from each other in winding direction.

3. The rotation member support configuration cording to claim 1, wherein each of the hook portions protrude outward from an outer periphery of the corresponding coil portion facing the hook portion.

4. The rotation member support configuration according to claim 1, wherein an angle formed by a free length direction of the first coil portion and a free length direction of the second coil portion is 80 degrees or more and 120 degrees or less.

5. The rotation member support configuration according to claim 1, wherein an angle formed between a direction where the hook portion at one end of the spring member protrudes from an outer periphery of the coil portion facing the hook portion and the coil portion at the other end is 45 degrees or more and 135 degrees or less.

6. The rotation member support configuration according to claim 1, wherein the bearing portion includes a convex-shaped portion protruding in a direction opposite to a pressing direction of the rotation member, and the connection portion presses the convex-shaped portion.

7. The rotation member support configuration according to claim 6, wherein, on an outer side of an abutment portion where the convex-shaped portion and the connection portion abut each other in a width direction of the bearing portion, a wall portion protruding from the abutment portion is disposed.

8. The rotation member support configuration according to claim 1, wherein a free length of each of the first coil portion and the second coil portion is longer than a length of the connection portion.

9. A fixing device comprising:

the rotation member support configuration according to claim 1, wherein the pressed member is a fixing member configured to fix an image on a recording medium, and the rotation member is a cleaning roller configured to press a cleaning web that cleans the fixing member against the fixing member.

10. A fixing device according to claim 9, wherein the fixing device comprises the cleaning web that cleans the fixing member and the cleaning roller presses the cleaning web against the fixing member.

* * * * *